US007493889B2

(12) United States Patent
Nickel et al.

(10) Patent No.: US 7,493,889 B2
(45) Date of Patent: Feb. 24, 2009

(54) METHOD FOR CONTROLLING THE COMPOSITION OF A FUEL/AIR MIXTURE FOR AN INTERNAL COMBUSTION ENGINE

(75) Inventors: Hans Nickel, Cottenweiler (DE); Claus Naegele, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 31 days.

(21) Appl. No.: 11/836,996

(22) Filed: Aug. 10, 2007

(65) Prior Publication Data

US 2008/0041338 A1 Feb. 21, 2008

(30) Foreign Application Priority Data

Aug. 16, 2006 (DE) ..... 10 2006 038 277

(51) Int. Cl.
*F02D 33/00* (2006.01)

(52) U.S. Cl. ..... 123/344; 123/406.24; 123/406.47

(58) Field of Classification Search ..... 701/103, 701/104, 105; 123/335, 478, 480, 344, 599, 123/339.11, 406.24, 406.47, 406.57
See application file for complete search history.

(56) References Cited

U.S. PATENT DOCUMENTS 4,979,477 A * 12/1990 Nickel et al. ..... 123/335
5,706,783 A * 1/1998 Sawada ..... 123/406.47
5,738,073 A * 4/1998 Koike et al. ..... 123/406.55
5,775,297 A * 7/1998 Koike et al. ..... 123/406.51
7,246,591 B2 * 7/2007 Shinogi et al. ..... 123/179.18
7,249,586 B2 * 7/2007 Andersson et al. ..... 123/335
7,252,055 B2 * 8/2007 Tani et al. ..... 123/90.15
7,328,100 B2 * 2/2008 Fukushima et al. ..... 701/114
2005/0168310 A1 8/2005 Nickel et al.
2007/0012284 A1 * 1/2007 Fukushima et al. ..... 123/333

* cited by examiner

*Primary Examiner*—Willis R. Wolfe, Jr.
*Assistant Examiner*—Johnny H. Hoang
(74) *Attorney, Agent, or Firm*—Gudrun E. Huckett

(57) ABSTRACT

In a method for controlling a composition of a fuel/air mixture supplied to an internal combustion engine, which engine has a speed control circuit maintaining an actual rotary speed of the crankshaft within preset limits and a controllable metering device for at least one component of the fuel/air mixture, a disruptive variable is introduced into the valve control circuit at a predeterminable point in time, the activity of an engine speed control circuit is monitored and evaluated immediately after introducing the disruptive variable, and, depending on the evaluation result, at least one parameter having an effect on the operation of the internal combustion engine is adjusted.

15 Claims, 4 Drawing Sheets

METHOD FOR CONTROLLING THE COMPOSITION OF A FUEL/AIR MIXTURE FOR AN INTERNAL COMBUSTION ENGINE

BACKGROUND OF THE INVENTION

The invention relates to a method for controlling a composition of a fuel/air mixture supplied to an internal combustion engine, in particular, an internal combustion engine embodied as a two-stroke engine. The internal combustion engine has a cylinder with a combustion chamber provided with a spark plug. The combustion chamber is delimited by a piston driving a crankshaft. An ignition control unit is connected to the spark plug and, depending on the rotary speed of the crankshaft, triggers at an adjusted ignition timing an ignition spark at the spark plug. A speed control circuit maintains the actual rotary speed of the crankshaft within preset limits. A controllable metering device is provided for at least one component of the fuel/air mixture.

Hand-held power tools such as motor chain saws, trimmers, blowers or similar devices are preferably driven by an internal combustion engine, for example, a two-stroke engine, that, when employing modern technology, is lively, powerful, and still can be operated in an environment-friendly way. In order to optimize operation of such a small-size engine with a displacement between approximately 20 cc and approximately 250 cc (cubic centimeters), microprocessors are used for engine control that, depending on operating parameters, control ignition of the internal combustion engine.

In regard to fuel systems it is also known to employ electromagnetic (solenoid) valves as disclosed in U.S. 2005/0168310 A1. Such a valve is used for controlling the fuel flow in order to adjust the quantity of fuel in regard to different operating parameters of the internal combustion engine.

When the engine speed of the internal combustion engine is monitored by a speed control circuit, the electronic system intervenes by changing the ignition timing in order to maintain the desired engine speed. In this way, the set idling speed during idling is controlled also. The controller used in this connection is usually a so-called PI or PID controller, i.e., a controller with a proportional term and an integral term.

Particularly in the case of a two-stroke engine, the engine speed is not only dependent on the ignition timing but also on the composition of the mixture. In case the mixture can also be varied as a control variable, a control intervention in regard to the mixture composition, on the one hand, and in regard to ignition timing, on the other hand, in particular during idling, can cause the system to undershoot or overshoot the control range. If this is the case, the engine can stall or the idle speed can no longer be maintained.

SUMMARY OF THE INVENTION

It is an object of the present invention to provide a method for engine speed control in which, on the one hand, the composition of the mixture supplied to an internal combustion engine is adjustable and, on the other hand, the ignition timing can be changed without running the risk that the control system overshoots or undershoots the control range.

In accordance with the present invention, this is achieved in that at a predeterminable point in time a disruptive variable is introduced and, immediately after introduction of the disruptive variable, the activity of the engine speed control circuit is monitored and evaluated. Depending on the result of the evaluation, at least one variable or a parameter having an effect on the operation of the internal combustion engine is adjusted; preferably, one of the components of the fuel/air mixture is adjusted. Other operating parameters are also suitable as a variable, for example, ignition timing, compression rate or the like.

After introduction of the disruptive variable, the engine speed as a command variable of the control circuit will try to adjust. The engine speed control circuit however will immediately counteract in order to maintain the preset engine speed. The engine speed control prevents an increase or drop of the engine speed by appropriate control intervention in the ignition. This activity of the engine speed control circuit is mirrored in the control term and is monitored and evaluated in order to control, based on the result of evaluation, the metering device for the components of the mixture in such a way that one component of the mixture, depending on the result of the evaluation of the activity, is adjusted in order to obtain a mixture composition with an optimized air ratio $\lambda$. In this way, the control term of the control circuit, for example, the proportional term of the engine speed controller can be evaluated as a parameter for the control deviation and the control intervention to be carried out. The proportional term of the control loop is thus a measure of the momentary ratio of fuel and air in the mixture. By evaluating the magnitude of the proportional term, the fuel amount and/or the mixture amount can be changed for optimization of the mixture composition such that the control circuit is safely prevented from overshooting/undershooting the control range.

For introducing the disruptive variable, advantageously a change of the fuel/air mixture is carried out wherein the fuel proportion and/or the mixture proportion can be changed.

Expediently, as a disruptive variable the fuel amount is changed by means of the electromagnetically controlled valve (solenoid valve) in order to adjust, depending on the detected activity of the control loop, the composition of the fuel/air mixture in regard to an optimal air ratio $\lambda$ (lambda value). This interaction between disruptive variable, control action, and change of the mixture proportions is done until an optimal value for the air ratio $\lambda$ is reached.

Expediently, the parameter to be changed for adjusting $\lambda$ is the fuel quantity of the fuel/air mixture; however, it can also be advantageous to change the air quantity instead of the fuel quantity.

The valve is operated as a synchronized valve that expediently is open in the currentless state. Also, a linear valve or a proportional valve can be used that is to be controlled appropriately.

DESCRIPTION OF THE PREFERRED EMBODIMENTS

Figure 1:
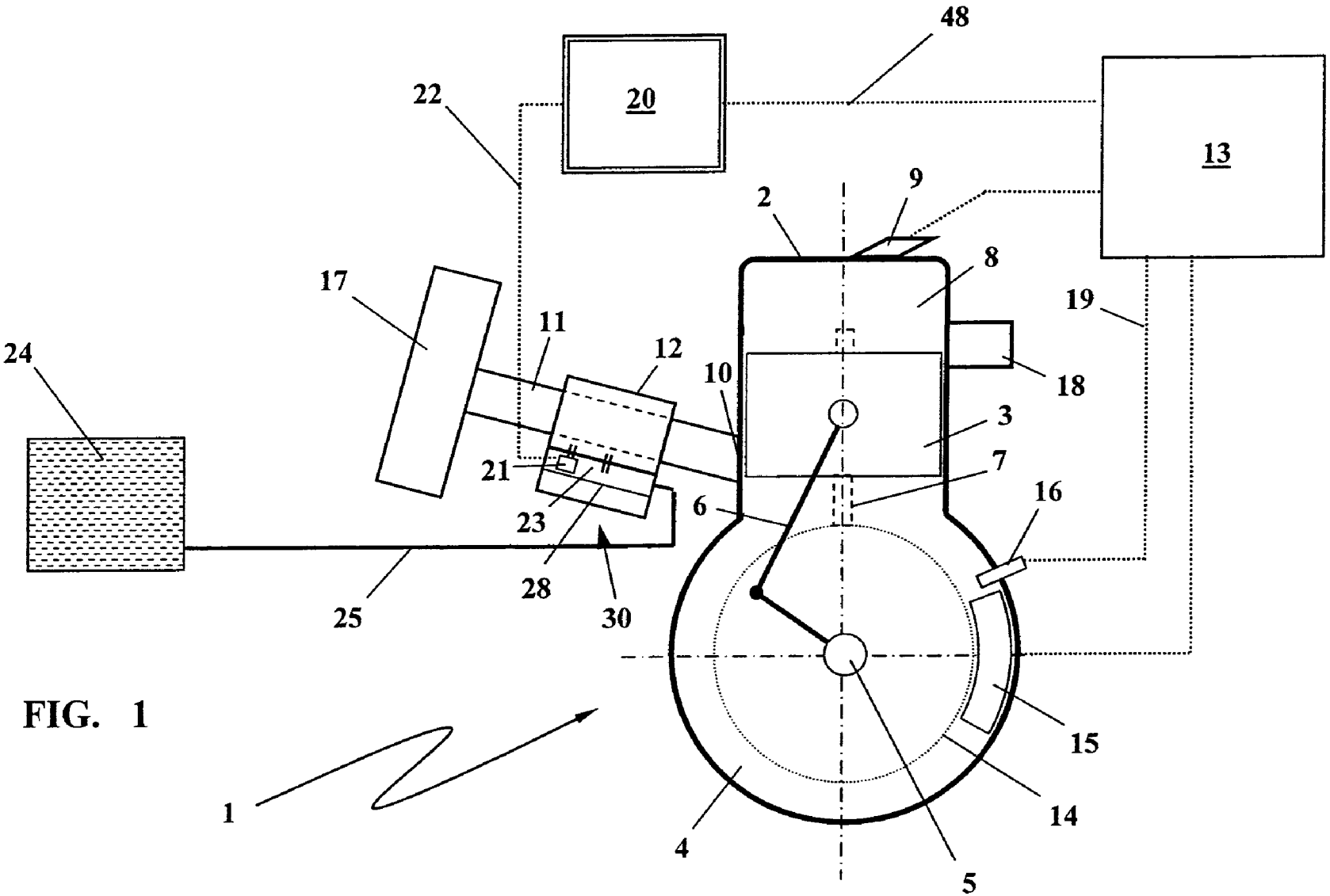
FIG. 1 is a schematic illustration of an internal combustion engine with intake part and schematically illustrated control circuit.

FIG. 1 shows an internal combustion engine 1 that is a two-stroke engine in the illustrated embodiment. The internal combustion engine can also be embodied as a four-stroke engine, a two-stroke engine with scavenging air or a similar engine. The internal combustion engine 1 illustrated in FIG. 1 has a cylinder 2 with a reciprocating piston 3 that drives in rotation a crankshaft 5 supported in crankcase 4. For this purpose, the crankshaft 5 is connected by means of a connecting rod 6 to the piston 3.

The piston 3 controls a mixture intake 10 that takes in combustion air through intake passage 11 and air filter 17 when underpressure is present within the crankcase 4. In the carburetor 12, fuel is admixed to the incoming combustion air. By means of the mixture intake 10 controlled by the piston 3 a fuel/air mixture is taken into the crankcase 4 and, as the piston moves downwardly, is conveyed through transfer passages 7 formed in the cylinder 2 into the combustion chamber 8. By means of ignition control unit 13 an ignition spark is triggered at the spark plug 9; the spark ignites the fuel/air mixture compressed in the internal combustion chamber 8 by the upwardly moving piston 3 and, upon downward stroke of the piston 3 as a result of combustion, the crankshaft 5 is driven. The combustion gases are exhausted by means of an exhaust port 18 that is preferably controlled by the piston 3.

A wheel 14, indicated in dashed lines, is connected to the crankshaft 5; it can be a flywheel, a fan wheel or a similar wheel. A magnet is arranged on the wheel 14 and induces a voltage in a coil 15 arranged stationarily relative to the circumference of the wheel 14. Moreover, on the wheel 14 an engine speed sensor 16 is arranged that monitors the engine speed of the internal combustion engine. The engine speed sensor 16 delivers a pulse sequence wherein for each revolution of the crankshaft 5 preferably several pulses are delivered. The pulse sequence is supplied by signal line 19 to the ignition control unit 13 and processed therein, preferably by using a processor.

The voltage of the stationary coil 15 is supplied to the ignition control unit 13 that provides the ignition energy for the spark at the spark plug 9. Moreover, by means of the induced voltage of the coil 15 a valve circuit 20 that is provided for controlling the solenoid valve 21 is operated also. The valve 21 is provided in the fuel system 30 and serves for controlling the fuel supply. For this purpose, the solenoid valve 21 is connected by control line 22 to the valve circuit 20.

In the illustrated embodiment, by an appropriate control of the solenoid valve 21 the fuel supply into the intake passage 11 is adjustable. It can also be expedient to supply air instead of fuel through a solenoid valve. In the illustrated embodiment, the fuel amount of the mixture is changed for adjusting the mixture. A control for changing the air quantity of the mixture operates in the same way.

Figure 2:
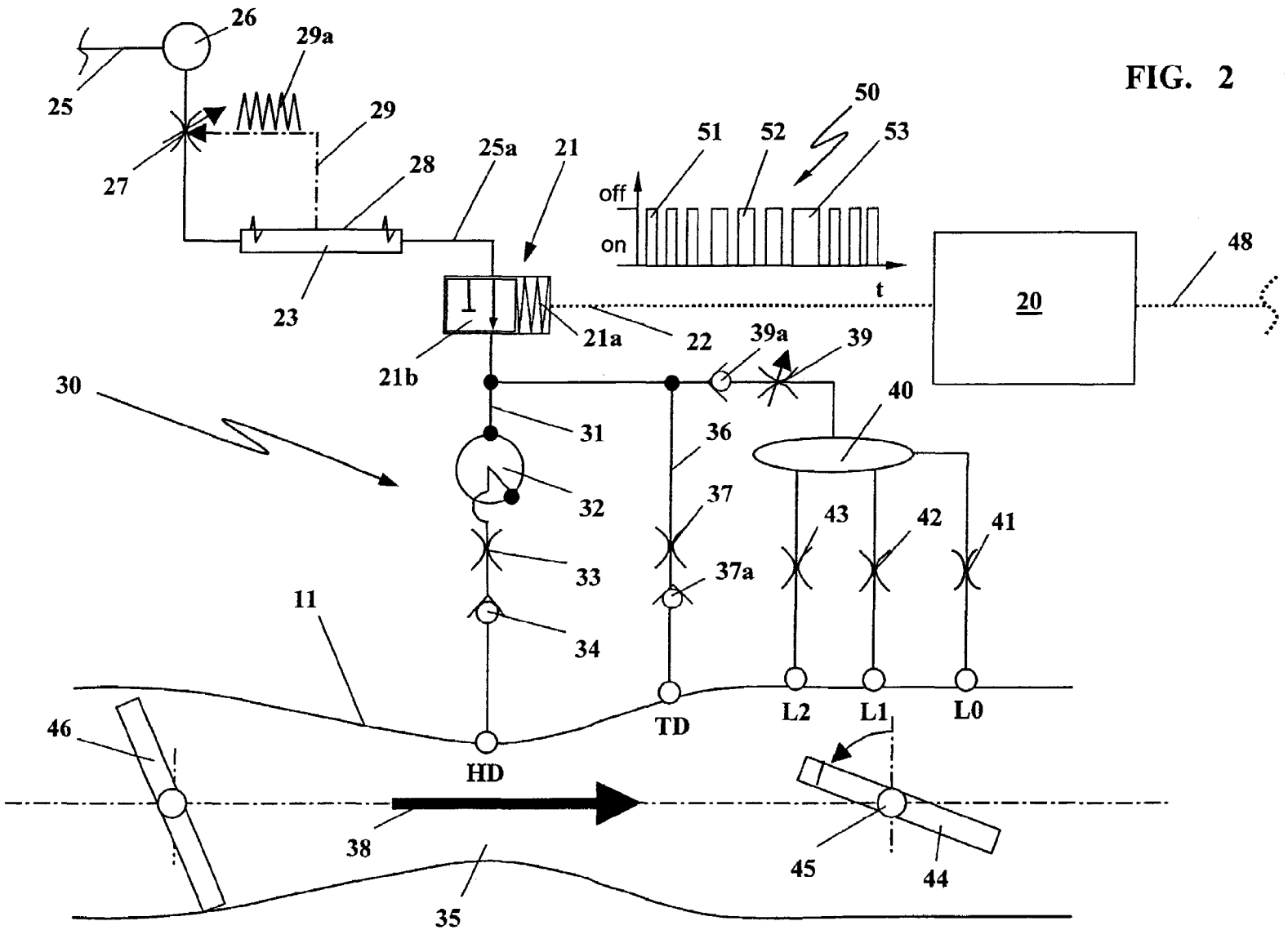
FIG. 2 is a schematic illustration of a basic circuit diagram of a carburetor arrangement with solenoid valve.

The fuel system 30 comprises a control chamber 23 of carburetor 12 as well as fuel tank 24 from where fuel is supplied to the control chamber via fuel line 25. As shown in FIG. 2, in the fuel line 25 a fuel pump 26 is arranged for this purpose. The fuel pump 26 can be driven, for example, by the alternating crankcase pressure in the crankcase 4 of the internal combustion engine 1. The pressure side of the fuel pump 26 is connected by intake valve 27 to the control chamber 23 that is delimited by a diaphragm 28. The diaphragm 28 controls by means of control lever 29 the intake valve 27 against the force of a spring 29*a*.

A fuel line 25*a* is connected to the control chamber 23 and branches off to a main jet HD, expediently a partial load jet TD and several idle jets L0, L1, and L2 opening into the intake passage 11.

In the embodiment according to FIG. 2, in the fuel line 25*a* between the control chamber 23 and the jets a switchable solenoid valve 21 is arranged that, as shown in FIG. 2, is open preferably in the currentless state. For this purpose, a spring 21*a* is provided, for example, that force-loads the valve member 21*b* into the open position. For closing the valve 21 and for thus blocking the fuel supply, a control coil of the solenoid valve 21 is to be supplied by valve control circuit 20 with supply voltage. When the supply voltage is supplied to the control coil of the valve 21, the valve member 21*b* is retracted against the force of the spring 21*a* and fuel supply is blocked.

FIG. 2 shows in an exemplary fashion a signal sequence 50 that can be supplied via the control line 22 to the valve 21. The valve 21, over time t, is either switched on or off. At the time when a signal is present, the valve 21 is always switched off. The valve is currentless and open. The width of the individual signals 51, 52, and 53 is adjusted in accordance with preset values of the valve control circuit 20 so that the valve 21 is controlled by a pulse width modulated signal sequence 50. It can also be expedient to configure the control pulses 51, 52, 53 to be of the same width and to supply a frequency-modulated signal sequence to the valve 21. Also, the use of an appropriately controlled linear valve or proportional valve can be expedient.

Downstream of the valve 21 the main jet path 31 is provided that is connected by means of adjusting element 32 as well as a throttle 33 and a check valve 34 to the main jet HD in the area of the venturi section 35 of the intake passage 11.

Parallel to the main jet path 31, there is a partial load jet path 36 that supplies by means of a fixed throttle 37 and a check valve 37*a* the partial load valve TD. The partial load valve TD in the flow direction 38 is downstream of the venturi section 35 approximately at the level of the idle jet L1. In the schematic illustrations of FIG. 2 and FIG. 5, the jets are illustrated adjacent to one another for the purpose of simplifying the drawing.

Downstream of the venturi section 35 and downstream of the main jet HD, a pivotable throttle valve 44 is positioned in the intake passage 11. In the pivot range of the throttle valve 44, the idle jets L1 and L2 open into the intake passage 11 and, downstream of the throttle valve 44, the exit port L0 is positioned. All ports L0, L1, L2 are supplied by means of a common idle chamber 40. The idle jet L1 is positioned approximately at the level of the axis 45 of the throttle valve 44 and is connected by throttle 42 to the idle chamber 40.

The idle jet L2 opens upstream of the idle jet L1 into the intake passage 11 and is connected also by means of throttle 43 to the idle chamber 40. The idle chamber 40 is connected by idle adjusting screw 39 and preferably a check valve 39*a* to the main jet path 31.

The exit port L0 opens downstream of the throttle valve 44 into the intake passage 11 and is connected by throttle 41 to the idle chamber 40.

Upstream of the venturi section 35 in the intake passage 11*a* choke 46 is arranged that, as is known in the art, is closed during cold start of the internal combustion engine in order to enrich the mixture.

The configuration of the fuel system 30 with solenoid valve 21 serves for providing a modified fuel supply in order to effect, independent of the vacuum in the intake passage 11, the fuel quantity. For this purpose, the valve control circuit 20 is provided that, through control line 48, is supplied with control signals of the ignition control unit 13.

Figures 3, 4:
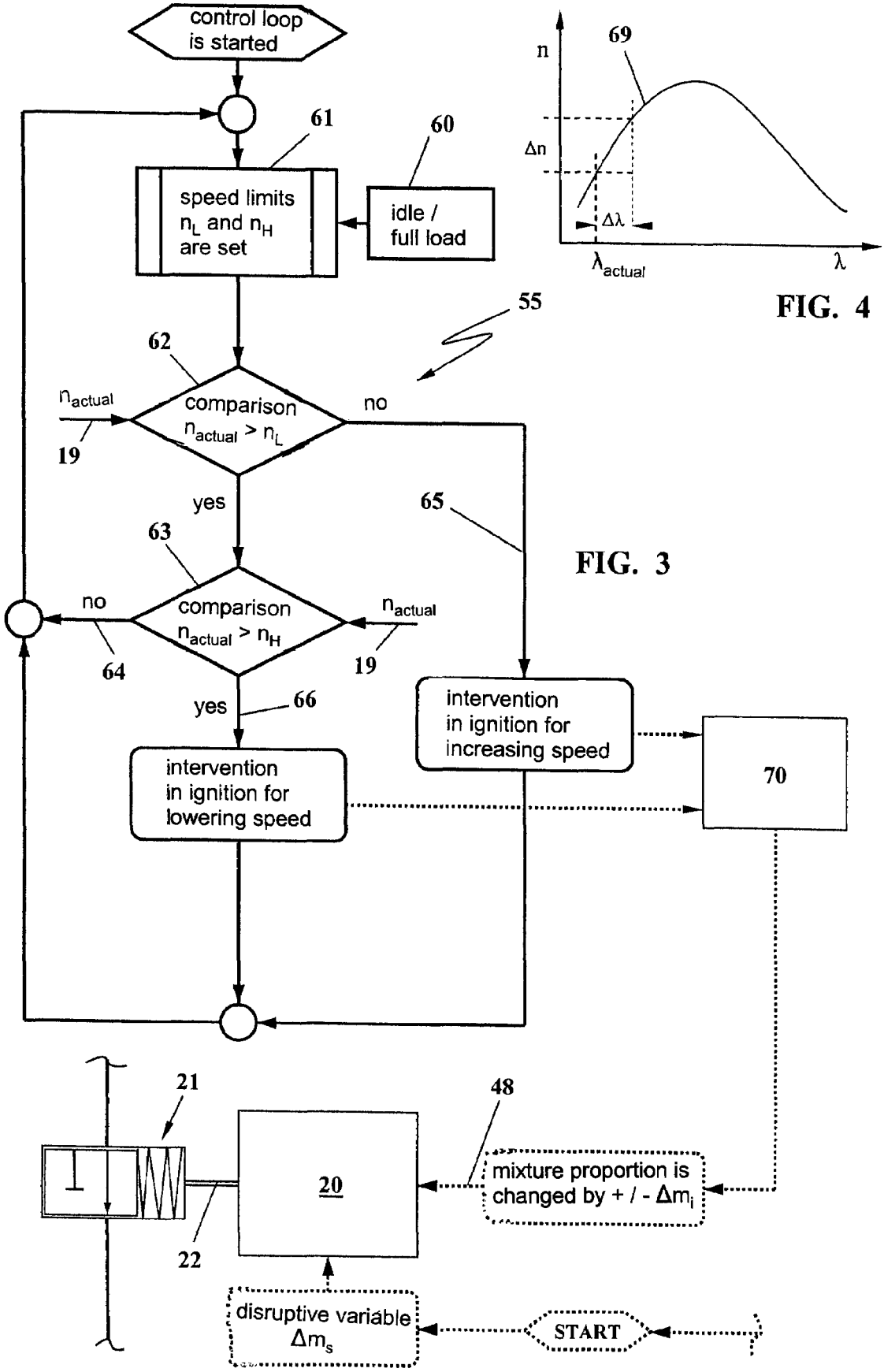
FIG. 3 is a flowchart illustrating schematically the method according to the invention.
FIG. 4 is a schematic illustration of an engine speed curve plotted against the air ratio $\lambda$.

The valve control illustrated in FIG. 3 comprises an engine speed control loop (circuit) 55 which is schematically illustrated by solid lines. After starting the control loop, depending on the load state of the internal combustion engine, engine speed limits are set within which the engine speed is to be maintained by the control loop. Expediently, a lower engine speed $n_L$ and an upper engine speed $n_H$ are set so that, for example, at idle the engine speed control loop 55 maintains the engine speed of the internal combustion engine precisely between the lower engine speed $n_L$ and the upper engine speed $n_H$. For example, an idle speed with a fluctuation width of 400/m can be preset. For recognizing the load state of the internal combustion engine, a load switch 60 can be provided whose output signal is evaluated in a setting unit 61 and converted to appropriate engine speed limits. The load switch 60 recognizes idle and load situations.

The preset engine speed limits are compared in the comparators 62 and 63 with the actual engine speed $n_{actual}$ that is supplied by means of the engine speed sensor 16. In the first comparator 62, the actual engine speed $n_{actual}$ is checked to see whether it is greater than the lower engine speed limit $n_L$. If this is the case, the second comparator 63 is activated which checks whether the actual engine speed $n_{actual}$ is greater than the upper engine speed limit $n_H$. Is this not the case, the loop is closed by means of branch 64 and another pass through the engine speed loop is carried out depending on the load state (idle/full load).

When in the first comparison in the comparator 62 it is determined that the actual engine speed $n_{actual}$ is below the lower engine speed limit $n_L$, branch 65 is activated by means of which an intervention in the ignition control unit 13 can be done in such a way that the engine speed is increased. In the same way, the comparator 63 is connected to branch 66 when the actual engine speed $n_{actual}$ is greater than the upper engine speed limit $n_H$. A pass through branch 66 causes an intervention in the ignition control in such a way that the engine speed is lowered. In both branches 65 and 66 this is done by adjusting the ignition timing to "advanced" or "retarded" or, for the purpose of lowering the engine speed, also by suppressing ignition. Both branches 65 and 66 return to the start of the control loop as does branch 64.

A constant idle speed and thus idle quality greatly depend on the composition of the mixture. Therefore, the solenoid valve 21 or 21*b* is provided for controlling the fuel supply. In order to achieve an optimal idle speed that is maintained as uniform as possible based on the engine speed control circuit, the mixture must be adjusted appropriately. FIG. 4 shows the dependency of the engine speed n on the mixture composition (air ratio λ).

FIG. 4 shows clearly that for a mixture that is too lean the engine speed greatly increases and, in an extreme situation, can no longer be lowered by the engine speed control circuit 55 to the desired idle speed. The system is then outside of the control range. On the other hand, FIG. 4 shows clearly that a mixture that is too rich leads to stalling of the internal combustion engine. The engine speed control circuit 55 can no longer compensate the engine speed drop caused by the mixture being too rich; the engine will stall.

In order to ensure a satisfactory control range of the engine speed control circuit 55 upwardly as well as downwardly, it is provided in accordance with the invention to introduce, in regular intervals or stochastically, a disruptive variable $\Delta m_s$ into the control loop, for example, by changing the mixture composition toward too rich or too lean, as is illustrated by dotted lines in the illustration of FIG. 3. At idle, the control can also be permanently active while in the other engine speed range it can operate stochastically.

The disruptive variable $\Delta m_s$ is supplied in accordance with criteria of the ignition control at predetermined timing; this is realized by an appropriate control of the valve control circuit 20. This can be done, for example, in that a signal 51 is made wider with regard to its pulse width for making the mixture more lean or is reduced with regard to its width for making the mixture richer.

Any change of the mixture, as shown in FIG. 4, has direct effects on the engine speed n of the internal combustion engine. As schematically illustrated in FIG. 4, when the mixture is made leaner, the engine speed n will increase. This increase of the engine speed is suppressed by the control loop. The internal combustion engine itself continues to operate substantially disruption-free wherein the engine speed branch 65 or 66 is used for compensation of the disruptive variable $\Delta m_s$. The activity of the engine speed controller 55 is reflected in the control term of the control loop so that information can be provided in regard to an expected engine speed deviation, without intervention of the control circuit, by monitoring the control term, e.g. the proportional term or the integral term or even a derivative term. Preferably, the proportional term of the control loop is monitored by a detection device 70 and evaluated. It will calculate, based on the magnitude of the monitored control term, a required change of a proportion of the mixture and supply an appropriate control signal to the valve control circuit 20 in order to change the mixture proportion by a control variable plus or minus $\Delta m_i$. The valve control circuit 20 changes in accordance with the obtained control command (control variable) the opening characteristics of the valve 21; this can be done by pulse width modulation or frequency modulation. The proportion of the fuel in the mixture is thus changed so that the air ratio λ for idle control is optimized, for example, and the engine speed is prevented from overshooting/undershooting the control range.

After a new adjustment of the mixture has been performed and the engine speed control loop 55 has compensated a possible engine speed change caused by the change in the mixture, a disruptive variable is supplied again after elapse of a rest period and the work of the engine speed control circuit 55 is evaluated again by monitoring the control term that is necessary for controlling the engine speed change expected as a result of the disruptive variable $\Delta m_s$. The overall arrangement is designed such that in the respective operating state an air ratio λ is adjusted to be within the range of an optimum 69 shown in FIG. 4.

Figure 5:
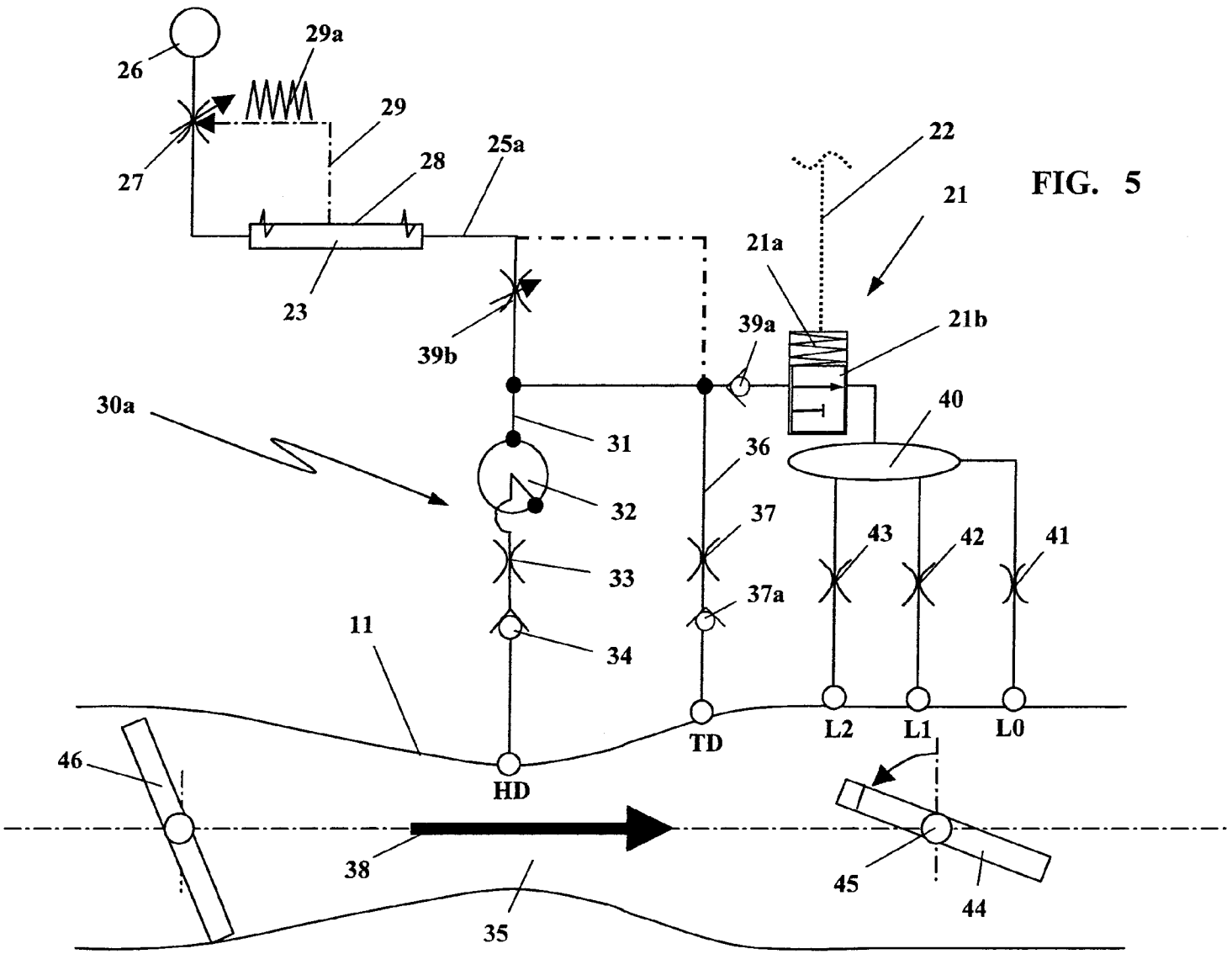
FIG. 5 is a schematic illustration of another carburetor arrangement with a solenoid valve for switching the idle jets.

In the embodiment according to FIG. 2, the valve is provided in the main fuel supply line 25*a*. In the embodiment according to FIG. 5, the preferably synchronized valve 21 is used for fuel supply into the idle system 40, 41, 42, 43. The configuration of the fuel system in FIG. 5 is essentially identical to that of FIG. 2 so that same parts are referenced by same reference numerals. In the main fuel supply path 25*a* to the fuel system 30*a*, an adjusting screw 39*b* for controlling the fuel supply is provided. The control of the valve 21 is realized again by valve control circuit 20 that receives appropriate control signals from the ignition control unit 13.

The arrangement according to the invention can be utilized in a simple way in connection with the control loop 55 of FIG. 3 or separate therefrom in order to adjust by appropriate control of the valve 21 the idle mixture with regard to its richness. When the load switch 60 indicates idle, the corresponding signal is processed and the valve control circuit 20 is controlled such that the richness of the mixture, i.e., the air ratio λ (lambda value) is constant. The mixture composition can be adjusted optimally wherein the engine speed itself is maintained exclusively by means of the ignition timing at the nominal value or within the preset nominal value limits.

In accordance with a different aspect of the invention, instead of maintaining the engine speed constant by changing the ignition timing by means of the engine speed control circuit, the engine speed can also be adjusted by changing the richness of the mixture. The control of the engine speed can also be realized by controlling the valve 21 and the adjustment of the proportions of fuel and air in the fuel/air mixture.

When for such a control action the engine switches from idle to load conditions, the valve 21 can be used in order to enrich the fuel/air mixture for improved acceleration. When the operation of the internal combustion engine causes a drop from high engine speed to idle (rich-come-down), the valve 21 can be controlled so as to provide a leaner mixture for avoiding the rich-come-down effect.

The arrangement according to FIG. 5 serves thus also for idle mixture control by means of the solenoid valve 21.

The specification incorporates by reference the entire disclosure of German priority document 10 2006 038 277.3 having a filing date of 16 Aug. 2006.

While specific embodiments of the invention have been shown and described in detail to illustrate the inventive principles, it will be understood that the invention may be embodied otherwise without departing from such principles.

What is claimed is:

1. A method for controlling a composition of a fuel/air mixture supplied to an internal combustion engine, wherein the internal combustion engine has a cylinder with a combustion chamber that is provided with a spark plug and delimited by a piston driving a crankshaft, wherein an ignition control unit is connected to the spark plug that, depending on a rotary speed of the crankshaft, triggers at an adjusted ignition timing an ignition spark at the spark plug, wherein a speed control circuit maintains an actual rotary speed of the crankshaft within preset limits, and wherein a controllable metering device is provided for at least one component of the fuel/air mixture; the method comprising the steps of:

introducing at a predeterminable point in time a disruptive variable into a valve control circuit;

monitoring and evaluating an activity of an engine speed control circuit immediately after introducing the disruptive variable;

adjusting, depending on a result of the step of evaluating, at least one parameter having an effect on operation of the internal combustion engine.

2. The method according to claim 1, wherein the at least one parameter is a component proportion of a fuel/air mixture.

3. The method according to claim 2, wherein, in the step of monitoring, a control term of the engine speed control circuit is monitored and, depending on a magnitude of the control term, a component of the mixture is changed with regard to a predetermined control variable.

4. The method according to claim 3, wherein the control term is a proportional term of the engine speed control circuit.

5. The method according to claim 3, wherein the control term is an integral term of the engine speed control circuit.

6. The method according to claim 3, wherein the control term is a derivative term of the engine speed control circuit.

7. The method according to claim 3, wherein the predetermined control variable is a fuel proportion of the fuel/air mixture.

8. The method according to claim 3, wherein the predetermined control variable is the air proportion of the fuel/air mixture.

9. The method according to claim 1, wherein the at least one parameter is the ignition.

10. The method according to claim 1, wherein the at least one parameter is the ignition timing.

11. The method according to claim 1, wherein the disruptive variable is a change of a component proportion of a fuel/air mixture.

12. The method according to claim 1, wherein the metering device is a synchronized valve.

13. The method according to claim 12, wherein the valve is open in a currentless state.

14. The method according to claim 1, wherein at idle the step of introducing is carried out at regular intervals for adjusting the at least one parameter.

15. The method according to claim 14, wherein the at least one parameter is the fuel/air mixture.

* * * * *